US007984749B2

(12) United States Patent
Streubel et al.

(10) Patent No.: US 7,984,749 B2
(45) Date of Patent: Jul. 26, 2011

(54) MAGNETIC DEVICE FOR CONTINUOUS CASTING MOLD

(75) Inventors: Hans Streubel, Erkrath (DE); Walter Trakowski, Duisburg (DE); Karls Rittner, Hilden (DE)

(73) Assignee: SMS Siemag AG, Duesseldorf (DE)

( * ) Notice: Subject to any disclaimer, the term of this patent is extended or adjusted under 35 U.S.C. 154(b) by 370 days.

(21) Appl. No.: 12/148,907

(22) Filed: Apr. 22, 2008

(65) Prior Publication Data

US 2008/0271871 A1 Nov. 6, 2008

Related U.S. Application Data

(63) Continuation-in-part of application No. 10/580,723, filed on May 24, 2006, now abandoned.

(30) Foreign Application Priority Data

Dec. 18, 2003 (DE) ..... 103 59 409
Sep. 25, 2004 (DE) ..... 10 2004 046 729

(51) Int. Cl.
*B22D 11/00* (2006.01)
*B22D 27/02* (2006.01)

(52) U.S. Cl. ..... 164/502; 164/466

(58) Field of Classification Search ..... 164/466, 164/468, 502, 504
See application file for complete search history.

(56) References Cited

U.S. PATENT DOCUMENTS 5,381,857 A * 1/1995 Tozawa et al. ..... 164/466
5,934,358 A 8/1999 Ellis
6,494,249 B1 * 12/2002 Kollberg et al. ..... 164/452

FOREIGN PATENT DOCUMENTS

WO WO 92/12814 * 8/1992

* cited by examiner

*Primary Examiner* — Kuang Lin
(74) *Attorney, Agent, or Firm* — Abelman, Frayne & Schwab

(57) ABSTRACT

The invention relates to a continuous casting mold, in particular a thin slab mold in which the flow of a liquid metal in the mold is influenced by a magnetic field generated by permanent magnets, wherein the permanent magnets have, over the width and/or height thereof, different magnetic strengths or are spaced from each other by different distances for a different field strength, so that to provide for variation of the magnetic field strength, the permanent magnets are differently adjusted in groups for changing a field strength distribution.

5 Claims, 6 Drawing Sheets

MAGNETIC DEVICE FOR CONTINUOUS CASTING MOLD

RELATED APPLICATIONS

This application is a continuation-in-part of application Ser. No. 10/580,723, filed May 24, 2006, now abandoned.

BACKGROUND OF THE INVENTION

1. Field of the Invention

The invention relates to a continuous casting mold, in particular a thin slab mold, in which the flow of liquid metal in the mold is influenced by a magnetic field which is generated by permanent magnets arranged on the mold, and wherein the permanent magnets have, over their width and/or height different magnetic strengths or are spaced from each other by different distances for a different field strength.

2. Description of the Prior Art

The use of magnetic means for braking and homogenizing the liquid metal flow is a known technique and is described in numerous technical documents. The installation components, which are described in the documents, have all large masses which make difficult the oscillation of the mold that is necessary for the operation.

The document EP O 880 417 B describes a magnetic brake for casting metal in a mold and which consists of a magnetic core and a coil supplied with permanent current or low-frequency alternating current. There is further provided a return line for closing the magnetic circuit.

The progress in the development in the field of permanent magnets (hard ferrites, rare-earth magnets) opened, meantime, new uses for possible field strengths of permanent magnets, which permanent magnets appears to be a suitable alternative for use instead of the above-described electrical magnet.

It has already been proposed to replace the electromechanical brake (EMBr) equipment, which was used up to the present for generating the magnetic field (field coils, electrical control, outer yoke for conducting the magnetic flux, etc.), with permanent magnets which are directly mounted on the mold.

The document EP 0568 579 describes a method of controlling the flow of the molten metal in a non-solidified metal region of a casting mold, wherein the mold is supplied with at least one primary flow of the molten metal and a cast strand is formed, and wherein at least one static magnetic field is generated by poles which are arranged adjacent to the mold and consist of permanent magnets. The magnetic field serves for breaking the primary flow of the molten metal flowing in the mold and for splitting the primary flow and for controlling the produced secondary flow. The magnetic field is so arranged that it acts over the entire width of the strand formed in the mold. The magnetic field should extend in a plane extending perpendicular to the cast direction and at level at which the magnetic field strength reaches its maximal value and can be varied within a range of from 60% to 100% of the maximal value, while simultaneously the field strength has a maximum value of 500 Gauss at a level with the highest outer surface/meniscus of the molten metal. The magnetic field is controlled and distributed by providing displaceable magnetic poles and/or adjustable core members.

The document EP 00 40 383 B1 describes a method of stirring the non-solidified region of a cast strand, wherein the strand is formed in a mold, and the cast steel flows through a pouring spout or directly into the mold. There, where the cast steel penetrates the melt already amassed in the mold, at least one static magnetic field is generated that brakes the cast or pouring steel and so splits it that its momentum is weakened or absorbed. The device, which is provided to this end, can be formed of one or several permanent magnets.

Document JP 08155610 discloses a rectangular mold in four corners of which permanent magnets are arranged for generating South and North magnetic fields.

Permanent magnets have a substantially smaller configuration at the same magnetic induction field strength and, therefore, a significantly reduced mass. They do not require any additional means for conducting a magnetic flux in form of an outside yoke. When necessary, it is sufficient to use ferromagnetic materials, which are available in the mold frame, for closing the magnetic flux circuit.

However, use of permanent magnets requires other special procedures. In the state of the art, permanent magnets are used as possible sources of static magnetic fields but only as equipment for the case when the magnetic field is generated by current coils with direct current DC or low-frequency alternating current, as discussed above, but not, however, for permanent magnets.

Because permanent magnets have no switch for turning on and off, they require special safety measures for installation and monitoring of the equipment. In distinction from the alternating current drive, special methods of equipment are necessary for operating a continuous casting machine.

With a magnetic brake, there are provided, on both sides of the mold opposite each other, permanent magnets for generating a magnetic field. The induction field strength at this arrangement follows, at a spacing between the permanent magnets in the intermediate space, an equation:

$$B(z) = 2 \cdot B_o \cdot \cosh \frac{\pi \cdot \left[ z - \frac{d}{2} \right]}{h}$$

wherein Bo is the induction field strength of one of the permanent magnets, z-distance from one of the magnets, d-distance between the magnets and h-operating height of the magnets. The operating height is determined by measurement. $\pi$ is the number Pi (=3.14 . . . ), and cos is a hyperbolic cosine (see FIG. 1).

An object of the invention is to provide a continuous casting mold in which the turbulence of the mold meniscus is reduced.

SUMMARY OF THE INVENTION

According to the invention, this and other objects of the present invention, which will become apparent hereinafter, are achieved by differently adjusting the permanent magnets in groups for a different distribution of the field strength so that the turbulence of the casting mold meniscus is reduced. The reduction of the meniscus turbulence results in higher surface quality of the cast thin slab.

According to an advantageous embodiment of the invention, the permanent magnets, which are supported on a carrier, are displaced by linearly displaceable and/or pivotable adjusting means relative to the mold for adapting the field strength to a desired flow velocity of liquid metal in the mold.

According to a further advantageous embodiment of the invention, the permanent magnetic carrier is formed as a rake, with rake teeth engaging reinforcing ribs of the water box and the permanent magnets being mounted on the rake teeth. This facilitates mounting of the carrier on the water box of the casting mold.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
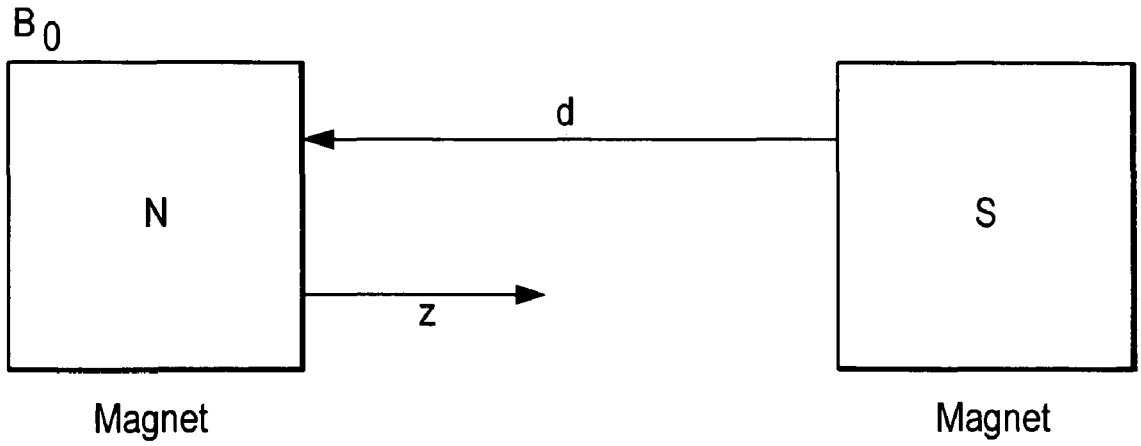
FIG. 1 a schematic view illustrating calculation of a field strength.
Figure 2A:
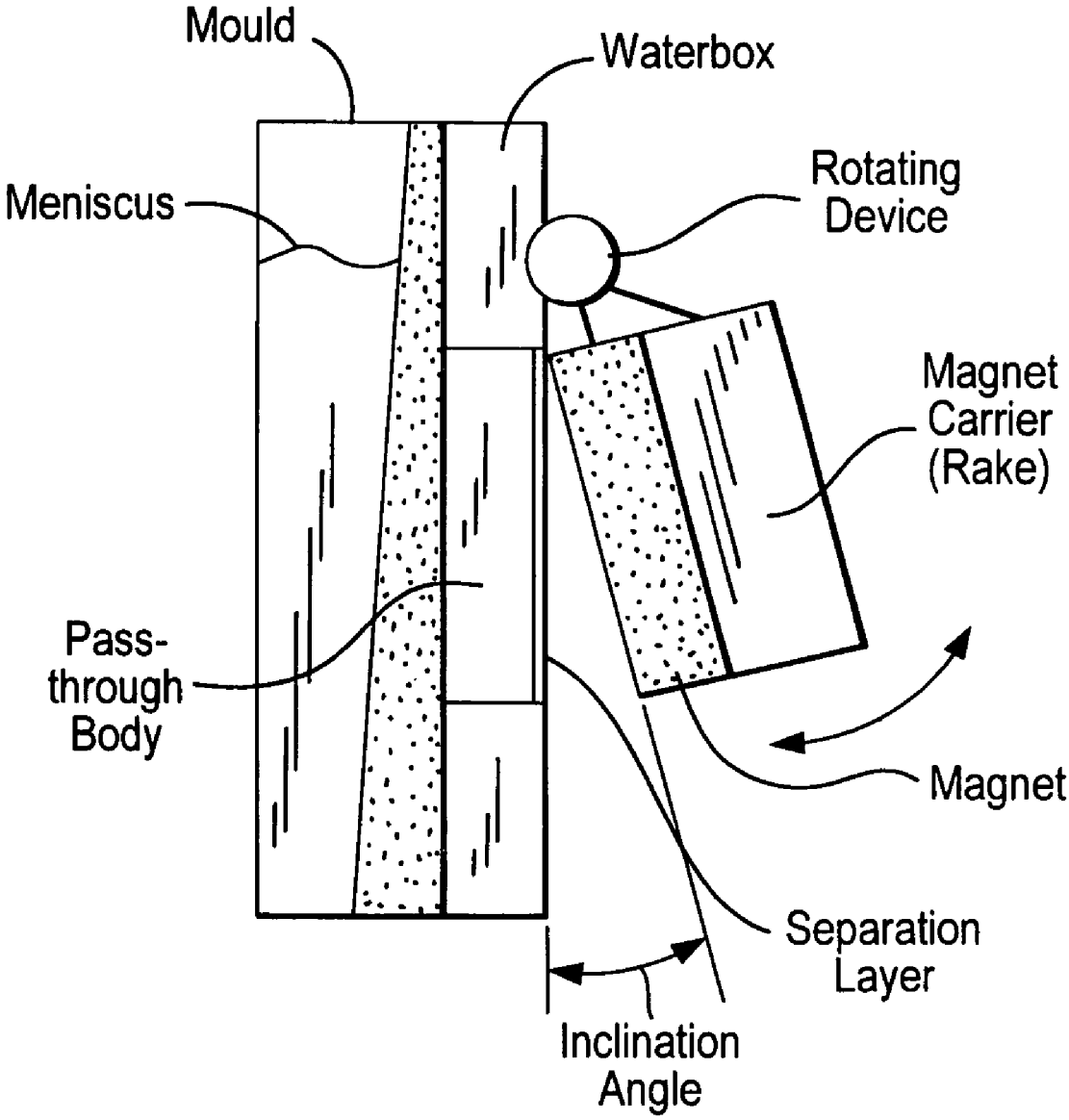
FIG. 2*a* a schematic view of a mold with means for varying the magnetic field strength according to a first embodiment of the present invention.
Figure 2B:
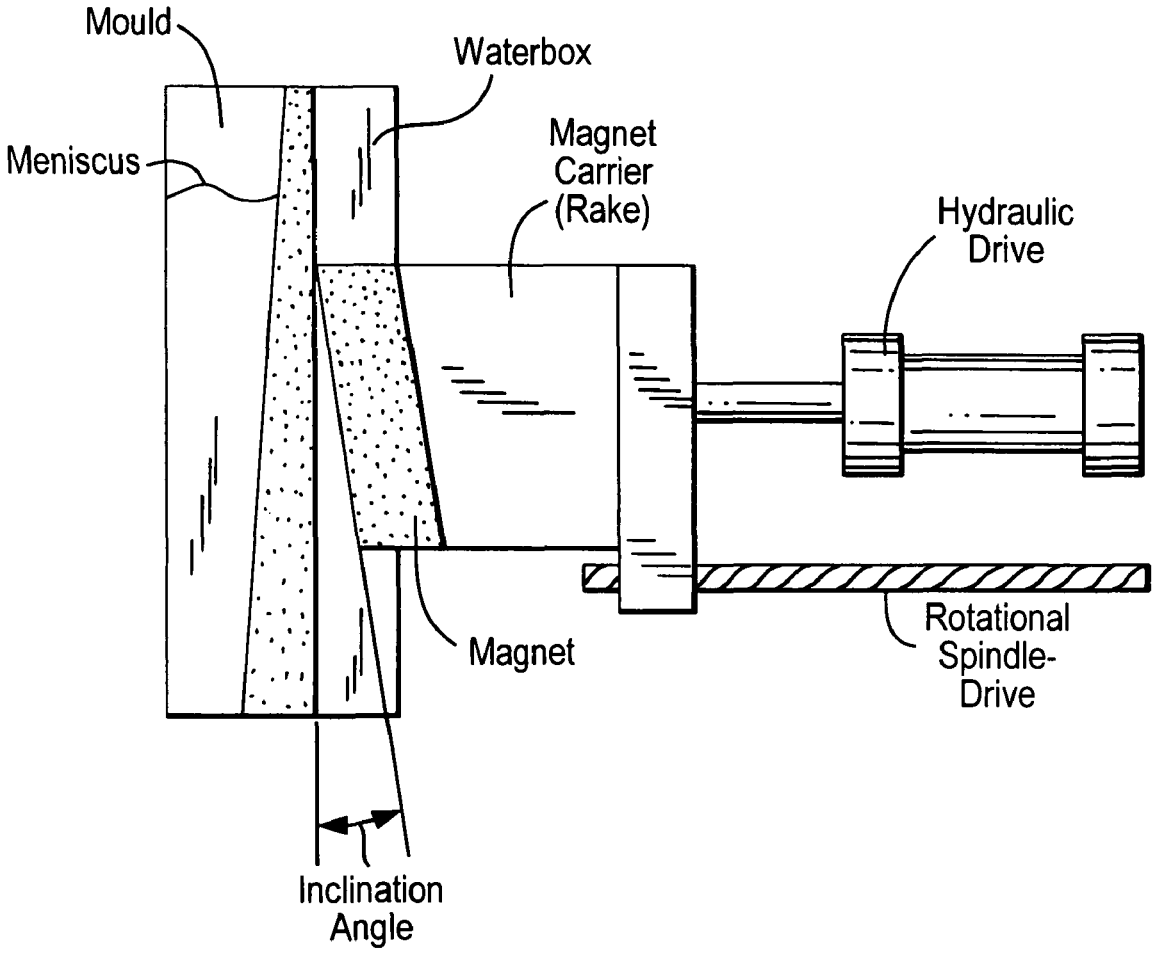
FIG. 2*b* a schematic view of a mold with means for varying the magnetic field strength according to a second embodiment of the present invention.

FIGS. 2*a*-2*b* shows schematically a casting mold assembly according to the present invention. The inventive casting mold assembly includes a mold through which liquid metal flows, a water box mounted on the mold, a carrier with permanent magnets which is mounted on the water box, and means for displacing the permanent magnets carrier relative to the mold.

According to the invention the distribution of the field strength along the mold is effected by changing the distance of the magnets from each other, advantageously, by pivoting the carrier of the permanent magnets away from the mold along a circular path (see FIG. 2*a*). There exist further possibilities of displacing the carrier linearly with rotatable spindles or hydraulic cylinders (see FIG. 2*b*). In case of pivoting of the magnet carrier away from the casting mold, the weakening of the field strength follows the following equation:

$$\Phi=|\vec{B}|\,|\vec{A}|\cos(<(B,A)),$$

where Φ is magnetic flux, B is magnetic field strength, A is a pass-through body to the casting mold, and cos is cosine of an angle between the vector of the magnetic field strength and the vector of the surface normal of the pass-through body. The varying of the magnetic flux is effected over the field weakening B according to the equation B (Ƶ) and the angle. In case of the mechanical displacement, as changing of the distance, changing of Φ is effected only over the field weakening B according to the above-mentioned equation over B(Ƶ).

With the permanent magnets carrier pivoting away from the mold, the field strength is reduced with increase of the distance from the meniscus. The reduction of the field strength with an increased distance from the meniscus facilitates flow of metal in the depth of the mold. With the linear movement of the carrier (according to FIG. 2*b*), the reduction of the field strength with an increased distance from the meniscus is achieved by arranging the carrier at angle to the mold.

The rotation facilitates, on one hand, detachment of the magnets from the pass-through body then, according to the instructions for mounting of these permanent magnets, they are put on an edge and, thereafter, are placed on the carrier with a constantly diminishing angle. Separate magnets, directly on the carrier which are formed from a ferromagnetic material, are not placed directly on the carrier likewise formed of a ferromagnetic material. Rather, to facilitate detachment of the magnets to provide for their rotation or mounting, a layer of a non-ferromagnetic material is provided between the carrier and the magnets. This can be an austenite steel, however, a plastic sheet with a thickness of about 1 mm suffices. The non-uniform distances of the magnets to the pass-through body, which are associated with rotation, are magnetically equalized by a pass-through body, the water box of the casting mold of a ferromagnetic material.

Figure 3:
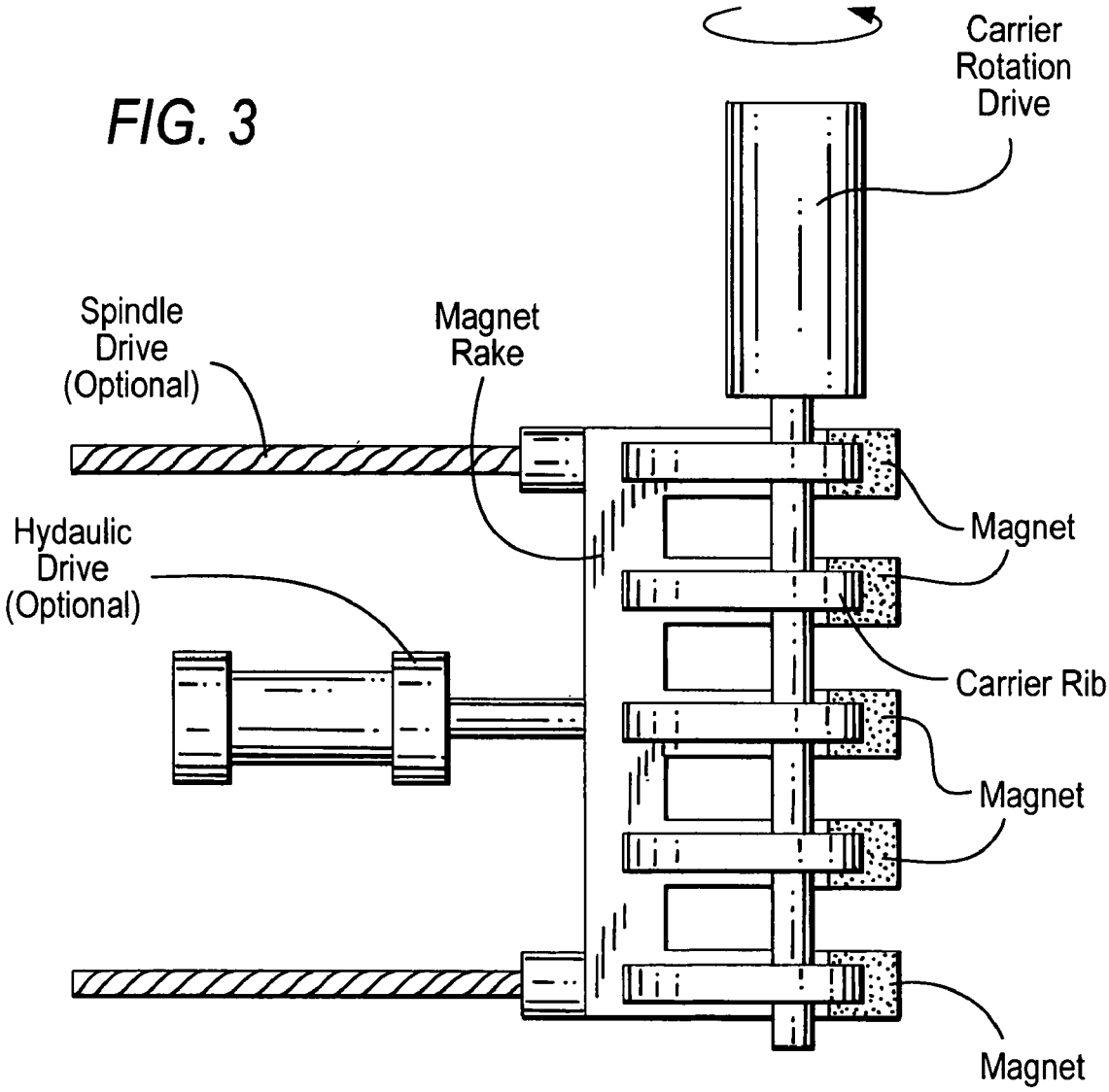
FIG. 3 a schematic view illustrating arrangement of permanent magnets or magnets carrier.

There exist two configuration of the casting mold, a mold with a recess for magnetic device advanced from outside, and a configuration with a magnetic device integrated into the water box. For both cases the following equipment is necessary:

Casting Molds with Window for a Magnetic Device Applied from the Outside:

The field strength of the magnetic field, which is generated by permanent magnets, should remain adjustable. To this end, the permanent magnets are mounted on the teeth of a rake (see FIG. 3) that engages the reinforcing ribs of the water box of a casting mold. A device provides for adjustment of the distance of the teeth to the mold by displacing the rake. Thereby, it is possible to vary the strength of the magnetic field. The device can be displaced by a mechanical spindle or a hydraulic cylinder.

Figure 5:
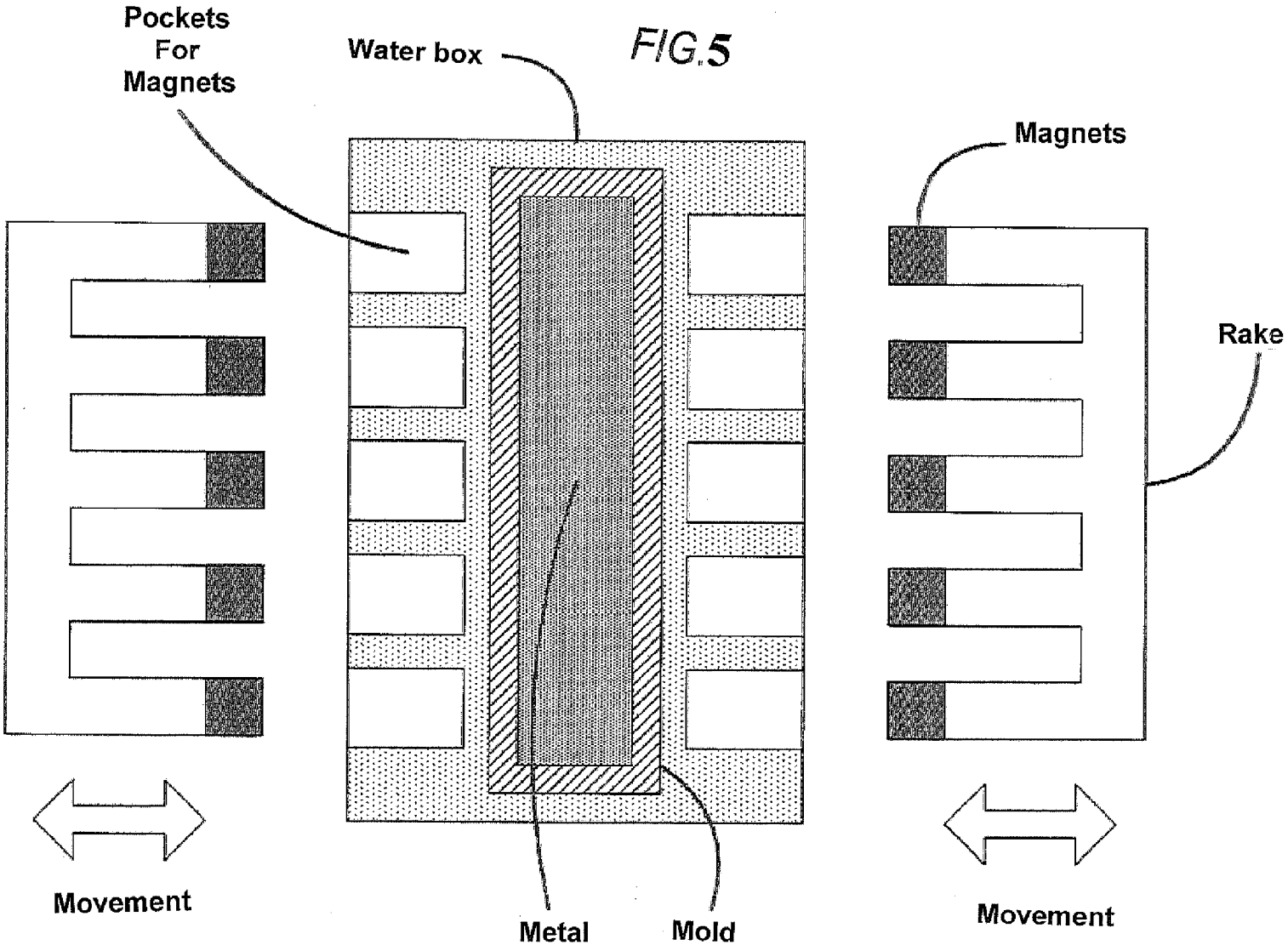
FIG. 5 a schematic view illustrating an arrangement of permanent magnets on teeth of a carrier rake and cooperation of the rake with the mold water box.

FIG. 5 illustrates arrangement of the magnets on the rake teeth and insertion of the rake teeth into pockets defined by reinforcing ribs of the water box that surrounds the mold.

Casting Molds with Integrated Magnetic Device:

The electrical device, which was used for generating a magnetic field, is removed, and then a device for holding the permanent magnets is mounted on an uncovered ferromagnetic block (the pass-through window) in the water box This device is displaceable by rotation and, thus, the magnetic field is varied. The device can be displaced by a mechanical spindle or by a hydraulic cylinder.

In addition, there exists a possibility to have this device rotate about an axis on the upper edge of the mold and, thereby, to provide for changing the distance between the permanent magnets and the ferromagnetic block. This likewise provides for adjusting the magnetic field strength.

Figure 4:
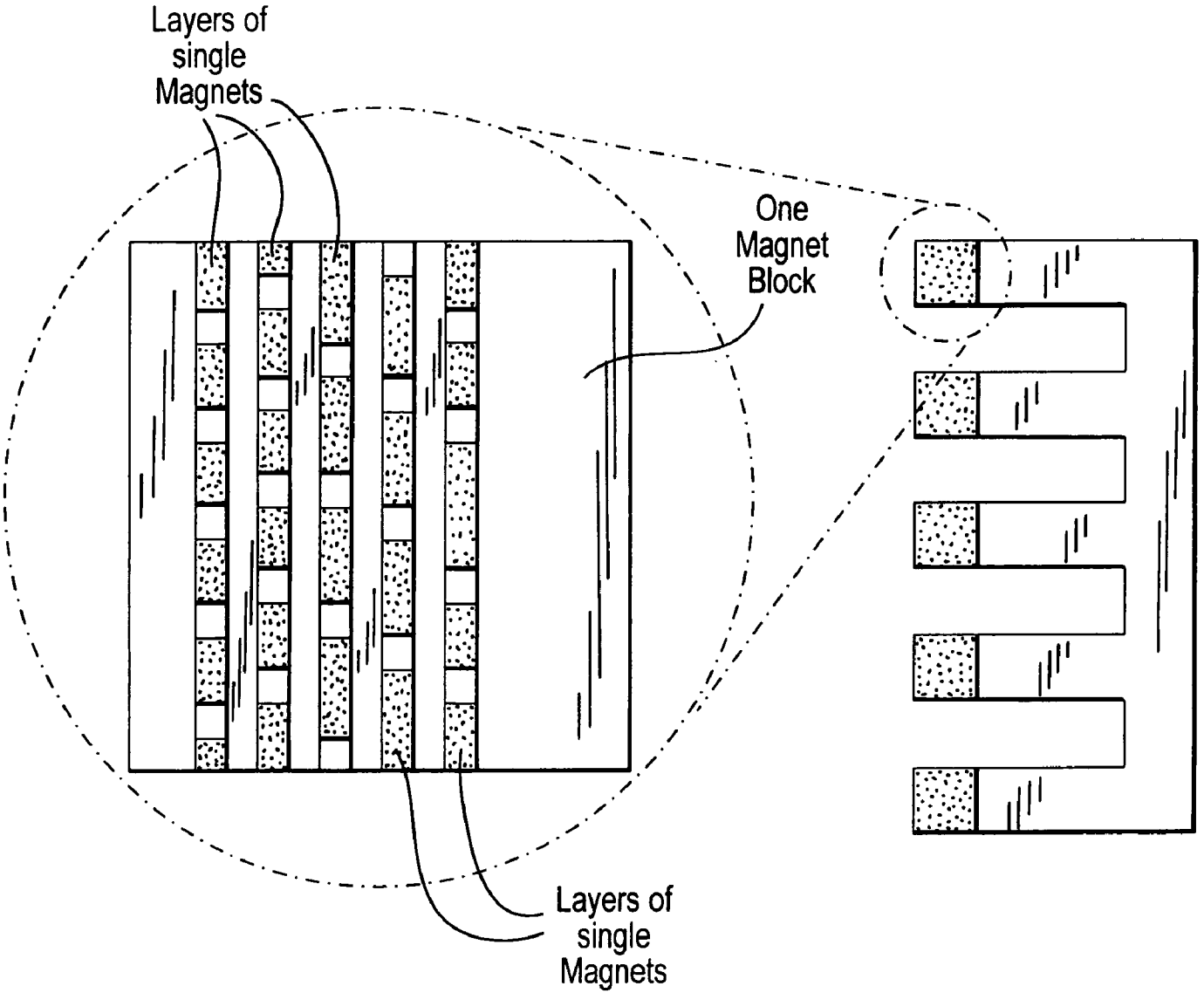
FIG. 4 a schematic view illustrating an arrangement of the permanent magnets on a carrier.

Permanent magnets are so strong that they cannot be made as large-surface elements. Such a magnet can explode under its own field strength, i.e., actually be destroyed. One is thus compelled to make large-surface magnets for the width of a continuous casting mold of a plurality of separate magnets which are glued onto a large-surface carrier of a ferromagnetic material (as shown in FIG. 4). In order to combine magnetic flux densities of the plurality of separate magnets into a large-surface magnetic flux which exercises a metallurgical effect in the mold.

It is to be pointed out that with the alignment of the magnetic poles of the magnets in the same direction, small magnets cannot be arranged tightly next to each other in an arbitrary manner, as the same poles would be repelled. Therefore, the magnet carrier should be formed of several layers, with the intermediate spaces of the first layer being covered by the permanent magnets in the adjacent second layer.

Further, with a rake (comb-shaped brake), the magnets are not only located on the teeth of the rake but also on the back side of the magnet carrier (rake) of several layers of a ferromagnetic material. Otherwise, the necessary magnetic flux density in the metallurgical section of the mold would not be reached.

Though the present invention was shown and described with references to the preferred embodiments, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A continuous casting mold assembly, comprising a casting mold; a water box mounted on the casting mold; permanent magnet means for generating a magnetic field that reduces the rate of deceleration of flow velocity of liquid metal in the mold in direction of flow of the liquid metal in the mold and including a plurality of permanent magnets arranged in the water box; and a carrier for supporting the permanent magnets and mounted on the water box, the permanent magnets having, in the direction of flow of the liquid metal in the mold, over a height thereof, different magnetic strengths or are spaced from each other by different distances for reducing magnetic field strength in the direction of flow of the liquid metal in the mold, so that to reduce the rate of deceleration of the flow velocity of the liquid metal in the direction of flow of the liquid metal; and means for displacing the carrier, together with the permanent magnets, relative to the mold for adaptation of the magnetic field strength to a desired flow velocity of the liquid metal in the mold.

2. A continuous casting mold assembly according to claim 1, wherein the displacing means comprises a rotating device for pivoting the permanent magnets carrier relative to the casting mold.

3. A continuous casting mold assembly according to claim 1, wherein the permanent magnets carrier comprises means for linearly displacing the carrier relative to the casting mold.

4. A continuous casting mold assembly according to claim 3, wherein the linearly displacing means comprises one of hydraulic cylinder and rotational spindle drive.

5. A continuous casting mold assembly according to claim 1, wherein the permanent magnets carrier is formed as a rake, with rake teeth engaging reinforcing ribs of the water box and the permanent magnets being mounted on the rake teeth.

* * * * *